US007198105B2

(12) United States Patent
Grant et al.

(10) Patent No.: US 7,198,105 B2
(45) Date of Patent: Apr. 3, 2007

(54) APPARATUS AND METHOD FOR CONTROLLING THE PRESSURE OF FLUID WITHIN A SAMPLE CHAMBER

(75) Inventors: Douglas W. Grant, Austin, TX (US); Edward Harrigan, Richmond, TX (US); Ian Traboulay, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/243,280

(22) Filed: Oct. 4, 2005

(65) Prior Publication Data

US 2006/0054323 A1 Mar. 16, 2006

Related U.S. Application Data

(62) Division of application No. 10/249,664, filed on Apr. 29, 2003, now Pat. No. 7,140,436.

(51) Int. Cl.
*E21B 49/10* (2006.01)
*E21B 49/00* (2006.01)

(52) U.S. Cl. ..... 166/305.1; 166/100; 166/169; 73/152.39

(58) Field of Classification Search ..... 166/305.1, 166/100, 252.1, 169; 73/152.23, 152.39; 175/59

See application file for complete search history.

(56) References Cited

U.S. PATENT DOCUMENTS 3,273,647 A * 9/1966 Briggs Jr. et al. ..... 166/100
3,273,659 A * 9/1966 Reynolds Jr. ..... 175/4
3,492,946 A * 2/1970 Martin ..... 73/863.02
3,577,781 A * 5/1971 Lebourg et al. ..... 73/152.26
3,858,445 A 1/1975 Urbanosky
3,911,740 A * 10/1975 Calhoun ..... 73/152.22
3,952,588 A * 4/1976 Whitten ..... 73/152.25
4,044,834 A * 8/1977 Perkins ..... 166/370
5,240,072 A 8/1993 Schultz et al.
5,353,637 A * 10/1994 Plumb et al. ..... 73/152.17
5,377,755 A * 1/1995 Michaels et al. ..... 166/264
5,662,166 A * 9/1997 Shammai ..... 166/264
5,822,951 A * 10/1998 Rosik ..... 53/432
6,029,744 A 2/2000 Baird (Continued)

FOREIGN PATENT DOCUMENTS

WO WO0050736 8/2000

*Primary Examiner*—David Bagnell
*Assistant Examiner*—Shane Bomar
(74) *Attorney, Agent, or Firm*—Matthias Abrell; Kevin P. McEnaney; William Batzer

(57) ABSTRACT

A formation testing tool and method for providing pressure controlled sampling is provided. A flow line delivers formation fluid to a sample chamber in the testing tool. A first valve controls the flow of formation fluid from the flow line to the sample chamber. A piston is slidably disposed in the sample chamber to define a sample cavity and a actuation cavity having variable volumes determined by movement of the piston. An actuator is also provided to move the piston in a first direction to increase the volume of the sample cavity and a second direction to decrease the volume of the sample cavity whereby formation fluid may be drawn into the sample cavity and pressurized therein using the actuator and the first valve.

8 Claims, 4 Drawing Sheets

U.S. PATENT DOCUMENTS 6,157,893 A 12/2000 Berger et al.
6,189,392 B1 * 2/2001 Schultz ..... 73/864
6,192,984 B1 2/2001 Schultz
6,305,482 B1 10/2001 Aumann et al.
6,386,017 B1 * 5/2002 Hewitt ..... 73/61.42
6,688,390 B2 * 2/2004 Bolze et al. ..... 166/264
6,837,314 B2 * 1/2005 Krueger et al. ..... 175/59

* cited by examiner

APPARATUS AND METHOD FOR CONTROLLING THE PRESSURE OF FLUID WITHIN A SAMPLE CHAMBER

CROSS REFERENCE TO RELATED APPLICATION

This application is a divisional of U.S. patent application Ser. No. 10/249,664 filled on Apr. 29, 2003 now U.S. Pat. No. 7,140,436 and assigned to the assignee of the present invention.

BACKGROUND OF THE INVENTION

1. Field of the Invention

This invention relates generally to formation fluid sampling, and more specifically to a chamber in a downhole tool for collecting and storing a sample of formation fluid.

2. Description of the Related Art

The desirability of taking downhole formation fluid samples for chemical and physical analysis has long been recognized by oil companies, and such sampling has been performed by the assignee of the present invention, Schlumberger, for many years. Samples of formation fluid, also known as reservoir fluid, are typically collected as early as possible in the life of a reservoir for analysis at the surface and, more particularly, in specialized laboratories. The information that such analysis provides is vital in the planning and development of hydrocarbon reservoirs, as well as in the assessment of a reservoir's capacity and performance.

The process of wellbore sampling involves the lowering of a sampling tool, such as the MDT™ formation testing tool, owned and provided by Schlumberger, into the wellbore to collect a sample or multiple samples of formation fluid by engagement between a probe member of the sampling tool and the wall of the wellbore. The sampling tool creates a pressure differential across such engagement to induce formation fluid flow into one or more sample chambers within the sampling tool. This and similar processes are described in U.S. Pat. Nos. 4,860,581; 4,936,139 (both assigned to Schlumberger); U.S. Pat. Nos. 5,303,775; 5,377,755 (both assigned to Western Atlas); and U.S. Pat. No. 5,934,374 (assigned to Halliburton).

The desirability of housing at least one, and often a plurality, of such sample chambers, with associated valving and flow line connections, within "sample modules" is also known, and has been utilized to particular advantage in Schlumberger's MDT tool. Schlumberger currently has several types of such sample modules and sample chambers, each of which provide certain advantages for certain conditions.

There is strong desire in the formation sampling market for cleaner samples that are taken under controlled conditions that are held as close as possible to true formation conditions, and for the sample to be maintained at these conditions until withdrawn from the wellbore and then transported to a laboratory for analysis. Current sampling techniques use either a pump or formation pressure to drive the formation fluid sample into a vessel such as a sample chamber, displacing a piston in the vessel as the formation fluid flows in. The piston in the vessel is passive and is moved by the fluid. In some designs, after the sample is taken and confined, pressure is applied to the other side of the piston by a gas charging system or by the borehole hydrostatic pressure to compress the sample in order to increase or maintain the sample at a given pressure for transport. Such attempts have produced only limited success.

To address this shortcoming, it is a principal object of the present invention to provide an apparatus and method for bringing a high quality formation fluid sample to the surface for analysis. It is a further object of the present invention to provide techniques for controlling the pressure of a collected formation fluid sample within the sample chamber. It is desirable that such a system eliminate the need for additional valves, additional power requirements and/or additional cost. To this end, another object of the present invention is to provide a configuration capable of functioning with only one flowline valve to lock in a sample, and that an actuator be provided that is capable of operating a piston and the required valve(s). It is also desirable to have a system that is capable of gathering fluids from and/or injecting fluids into the formation.

SUMMARY OF THE INVENTION

The objects described above, as well as various other objects' and advantages, are achieved by a formation testing tool adapted for insertion into a subsurface wellbore. The testing tool includes a sample chamber for receiving and storing formation fluid, a flow line for delivering formation fluid to the sample chamber, and a first valve for controlling the flow of formation fluid from the flow line to the sample chamber. A piston is slidably disposed in the sample chamber to define a sample cavity and an actuation cavity, and the cavities have variable volumes determined by movement of the piston. An actuator moves the piston in a first direction to increase the volume of the sample cavity and a second direction to decrease the volume of the sample cavity, whereby formation fluid may be drawn into the sample cavity and pressurized therein using the actuator and the first valve.

In one aspect, the actuation cavity is divided into an outer actuation cavity and an inner actuation cavity. In this embodiment, the actuator includes a hydraulic flow line connected to a source of hydraulic fluid. A second valve controls the flow of hydraulic fluid from the hydraulic flow line to the inner actuation cavity, and a third valve controls the flow of hydraulic fluid from the hydraulic flow line to the outer actuation cavity, whereby pressurized hydraulic fluid may be selectively delivered to the inner and outer actuation cavities for respectively moving the piston in the first and second directions. The actuator may further include a pump and a compensator.

It is preferred that the sample chamber include a first cylindrical portion having a first internal diameter and a second cylindrical portion having a second internal diameter. The second internal diameter is larger than the first internal diameter. The piston preferably has a first tubular portion adapted for sealed sliding movement within the first cylindrical portion of the chamber and a second tubular portion adapted for sealed sliding movement within the second cylindrical portion of the chamber. The second tubular portion of the piston defines the inner and outer actuation cavities within the second cylindrical portion of the sample chamber.

It is further preferred that a stationary tubular element be disposed concentrically in the first cylindrical portion of the sample chamber. The first and second tubular portions of the piston are then adapted for sliding movement about and along the stationary tubular element.

It is further preferred that the cross-sectional area of the outer actuation cavity is greater than the cross-sectional area of the inner actuation cavity, and that the cross-sectional area of the inner actuation cavity is greater than the cross-sectional area of the sample cavity. In this manner, the hydraulic fluid pressure applied to the outer actuation cavity is magnified by the ratios of the cross-sectional areas to efficiently pressurize the fluid in the sample cavity.

It is also preferred that a locking mechanism that permits the piston to be moved in the second direction but not in the first direction, whereby the pressure of fluid in the sample cavity may be maintained even though the pressure in the outer actuation cavity is decreased, is also included.

A source of fluid at reduced pressure placed in selective communication with the inner actuation cavity, whereby the pressure within the inner actuation cavity may be reduced by fluid communication with the reduced-pressure source to increase the pressure applied to the sample cavity by the pressure in the outer actuation cavity, may also be included.

In another aspect, the actuator includes an electric motor, and a power screw assembly driven by the electric motor. The power screw assembly has a lead screw connected to the piston for selectively moving the piston in the first and second directions.

A gear reducer disposed between the electric motor and the power screw assembly for efficient application of the electric motor's torque to the power screw assembly may also be provided.

In yet another aspect, an apparatus for obtaining fluid from a subsurface formation penetrated by a wellbore is provided. The apparatus includes a probe assembly for establishing fluid communication between the apparatus and the formation when the apparatus is positioned in the wellbore, and a sample module for collecting a sample of the formation fluid from the formation. The sample module includes a sample chamber for receiving and storing formation fluid, and a flow line for delivering formation fluid to the sample chamber. A first valve controls the flow of formation fluid from the flow line to the sample chamber. A piston is slidably disposed in the sample chamber to define a sample cavity and an actuation cavity, the cavities having variable volumes determined by movement of the piston. An actuator moves the piston in a first direction to increase the volume of the sample cavity and a second direction to decrease the volume of the sample cavity, whereby formation fluid may be drawn into the sample cavity and pressurized therein using the actuator and the first valve.

In another aspect, a method for obtaining fluid from a subsurface formation penetrated by a wellbore, and includes the steps of positioning a formation testing apparatus having a sample chamber therein within the wellbore, the sample chamber having a piston therein that divides the sample chamber into a fluid cavity and a actuation cavity, and establishing selective fluid communication via a control valve between the sample cavity of the sample chamber and the formation is provided. Once the control valve is opened, the piston is induced to move in a first direction so as to expand the sample cavity and thereby draw formation fluid into the sample cavity. After the control valve is closed, the piston is induced to move in a second direction so as to compress the sample cavity and thereby pressurize the formation fluid drawn into the sample cavity. The piston is locked against movement in the first direction so as to maintain the pressure in the sample chamber, and the apparatus is withdrawn from the wellbore to recover the collected formation fluid.

In yet another aspect, the invention relates to a method of injecting fluid into a formation. The method includes inserting fluid into a formation testing apparatus having a piston therein that divides the sample chamber into a fluid cavity and a actuation cavity, positioning the downhole tool in the wellbore, pressurizing the fluid in the fluid cavity, establishing selective fluid communication between the fluid cavity and the formation and inducing movement of the piston to eject formation fluid from the fluid cavity into the formation.

The piston movement may be induced by pressurized hydraulic fluid delivered to the actuation cavity. It is preferred that the actuation cavity be divided by an enlarged diameter portion of the piston into inner and outer actuation cavities that are selectively pressurized by pressurized hydraulic fluid to move the piston in the first and second directions.

Alternatively, the piston movement may be induced by an electric motor and power screw assembly. A gear reducer be disposed between the electric motor and power screw assembly for efficient application of the motor's torque to the power screw assembly.

BRIEF DESCRIPTION OF THE DRAWING(S)

The manner in which the present invention attains the above recited features, advantages, and objects can be understood with greater clarity by reference to the preferred embodiments thereof which are illustrated in the accompanying drawings.

It is to be noted however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
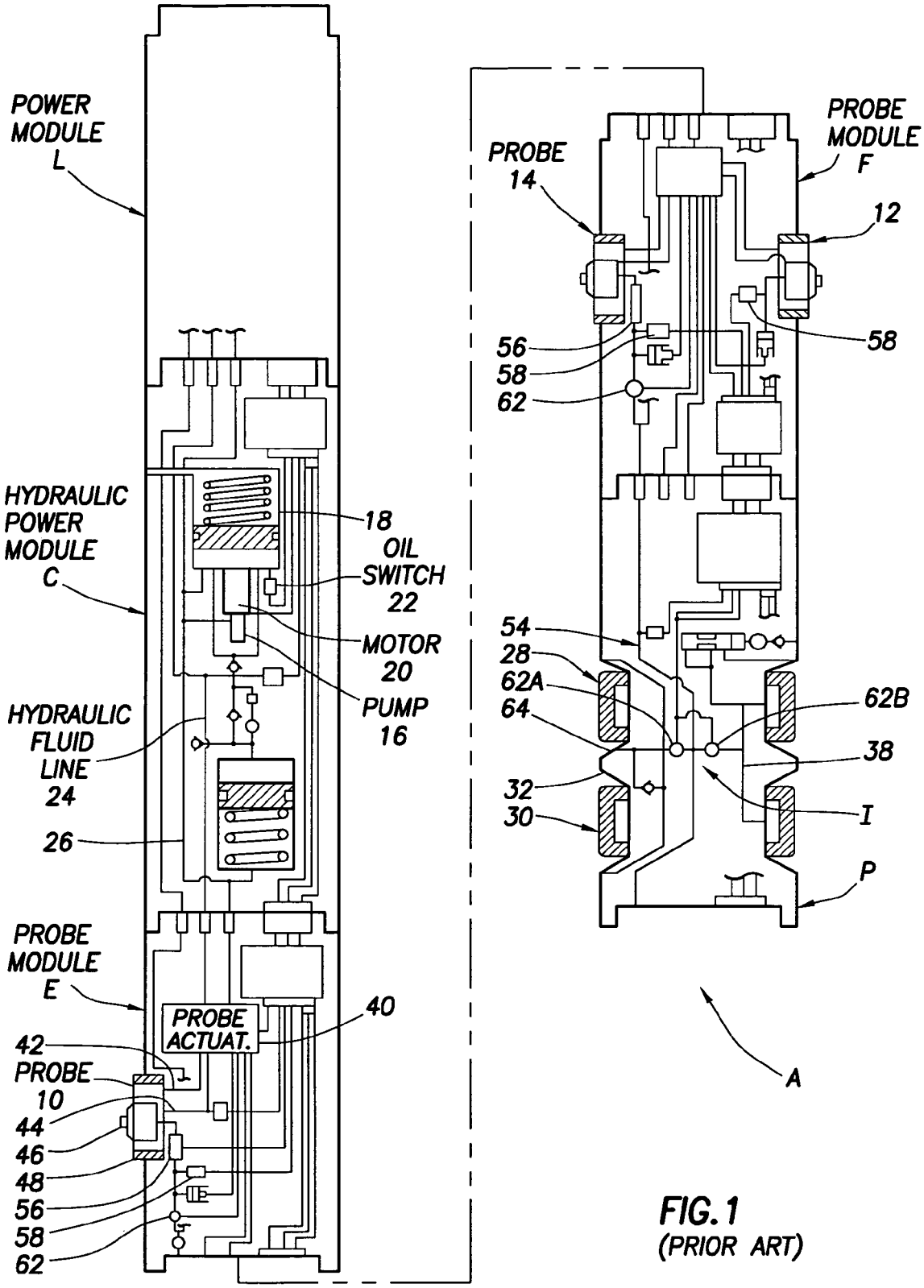
FIG. 1 (PRIOR ART)
FIGS. 1 and 2 are schematic illustrations of a prior art formation testing apparatus and its various modular components.
Figure 2:
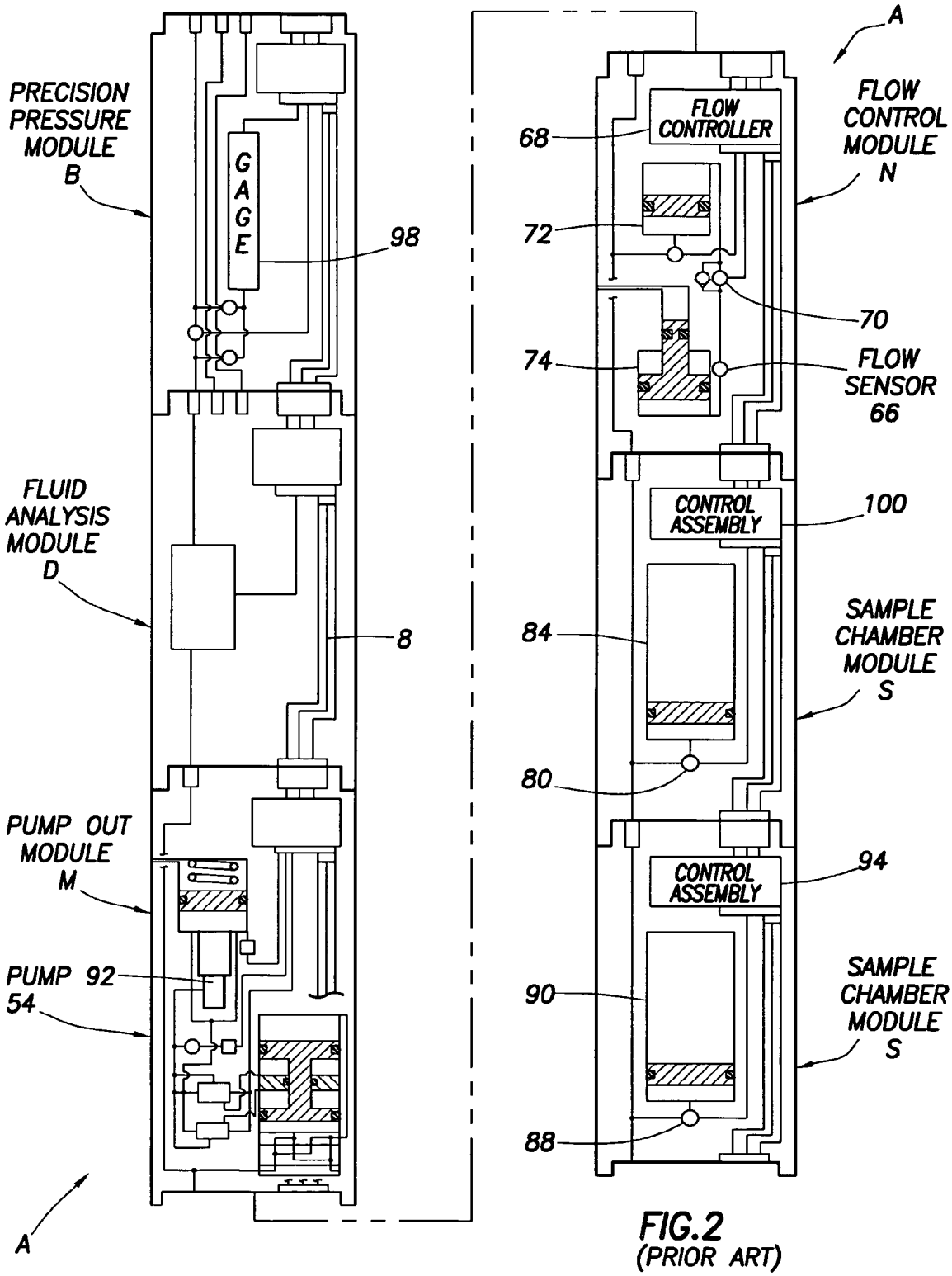
FIG.2 (PRIOR ART)

Turning now to prior art FIGS. 1 and 2, a preferred apparatus with which the present invention may be used to advantage is illustrated schematically. The apparatus A of FIGS. 1 and 2 is preferably of modular construction although a unitary tool is also useful. The apparatus A is a down hole tool which can be lowered into the well bore (not shown) by a wire line (not shown) for the purpose of conducting formation property tests. The wire line connections to the tool as well as power supply and communications-related electronics are not illustrated for the purpose of clarity. The power and communication lines which extend throughout the length of the tool are generally shown at 8. These power supply and communication components are known to those skilled in the art and have been in commercial use in the past. This type of control equipment would normally be installed at the uppermost end of the tool adjacent the wire line connection to the tool with electrical lines running through the tool to the various components.

As shown in FIG. 1, the apparatus A has a hydraulic power module C, a packer module P, and a probe module E. Probe module E is shown with one probe assembly 10 which may be used for permeability tests or fluid sampling. When using the tool to determine anisotropic permeability and the vertical reservoir structure according to known techniques, a multiprobe module F can be added to probe module E, as shown in FIG. 1. Multiprobe module F has sink probe assemblies 12 and 14.

The hydraulic power module C includes pump 16, reservoir 18, and motor 20 to control the operation of the pump. Low oil switch 22 also forms part of the control system and is used in regulating the operation of pump 16. It should be noted that the operation of the pump may be controlled by pneumatic or hydraulic means.

Hydraulic fluid line 24 is connected to the discharge of pump 16 and runs through hydraulic power module C and into adjacent modules for use as a hydraulic power source. In the embodiment shown in FIG. 1, hydraulic fluid line 24 extends through hydraulic power module C into packer module P via probe module E and/or F depending upon which configuration is used. The hydraulic loop is closed by virtue of hydraulic fluid return line 26, which in FIG. 1 extends from probe module E back to hydraulic power module C where it terminates at reservoir 18.

The pump-out module M, seen in FIG. 2, can be used to dispose of unwanted samples by virtue of pumping fluid through flow line 54 into the borehole, or may be used to pump fluids from the borehole into the flow line 54 to inflate straddle packers 28 and 30. Furthermore, pump-out module M may be used to draw formation fluid from the wellbore via probe module E or F, and then pump the formation fluid into sample chamber module S against a buffer fluid therein. This process will be described further below.

Bi-directional piston pump 92, energized by hydraulic fluid from pump 91, can be aligned to draw from flow line 54 and dispose of the unwanted sample though flow line 95 or may be aligned to pump fluid from the borehole (via flow line 95 ) to flow line 54. The pump out module M has the necessary control devices to regulate pump 92 and align fluid line 54 with fluid line 95 to accomplish the pump out procedure. It should be noted here that pump 92 can be used to pump samples into sample chamber module(s) S, including overpressuring such samples as desired, as well as to pump samples out of sample chamber module(s) S using pump-out module M. Pump-out module M may also be used to accomplish constant pressure or constant rate injection if necessary. With sufficient power, the pump out module may be used to inject fluid at high enough rates so as to enable creation of microfractures for stress measurement of the formation.

Alternatively, straddle packers 28 and 30 shown in FIG. 1 can be inflated and deflated with hydraulic fluid from pump 16. As can be readily seen, selective actuation of the pump-out module M to activate pump 92 combined with selective operation of control valve 96 and inflation and deflation valves I, can result in selective inflation or deflation of packers 28 and 30. Packers 28 and 30 are mounted to outer periphery 32 of the apparatus A, and are preferably constructed of a resilient material compatible with wellbore fluids and temperatures. Packers 28 and 30 have a cavity therein. When pump 92 is operational and inflation valves I are properly set, fluid from flow line 54 passes through inflation/deflation means I, and through flow line 38 to packers 28 and 30.

As also shown in FIG. 1, the probe module E has probe assembly 10 which is selectively movable with respect to the apparatus A. Movement of probe assembly 10 is initiated by operation of probe actuator 40, which aligns hydraulic flow lines 24 and 26 with flow lines 42 and 44. Probe 46 is mounted to a frame 48, which is movable with respect to apparatus A, and probe 46 is movable with respect to frame 48. These relative movements are initiated by controller 40 by directing fluid from flow lines 24 and 26 selectively into flow lines 42 and 44 with the result being that the frame 48 is initially outwardly displaced into contact with the borehole wall (not shown). The extension of frame 48 helps to steady the tool during use and brings probe 46 adjacent the borehole wall. Since one objective is to obtain an accurate reading of pressure in the formation, which pressure is reflected at the probe 46, it is desirable to further insert probe 46 through the built up mudcake and into contact with the formation. Thus, alignment of hydraulic flow line 24 with flow line 44 results in relative displacement of probe 46 into the formation by relative motion of probe 46 with respect to frame 48. The operation of probes 12 and 14 is similar to that of probe 10, and will not be described separately.

Having inflated packers 28 and 30 and/or set probe 10 and/or probes 12 and 14, the fluid withdrawal testing of the formation can begin. Sample flow line 54 extends from probe 46 in probe module E down to the outer periphery 32 at a point between packers 28 and 30 through adjacent modules and into the sample modules S. Vertical probe 10 and sink probes 12 and 14 thus allow entry of formation fluids into sample flow line 54 via one or more of a resistivity measurement cell 56, a pressure measurement device 58, and a pretest mechanism 59, according to the desired configuration. When using module E, or multiple modules E and F, isolation valve 62 is mounted downstream of resistivity sensor 56. In the closed position, isolation valve 62 limits the internal flow line volume, improving the accuracy of dynamic measurements made by pressure gauge 58. After initial pressure tests are made, isolation valve 62 can be opened to allow flow into other modules.

When taking initial samples, there is a high prospect that the formation fluid initially obtained is contaminated with mud cake and filtrate. It is desirable to purge such contaminants from the sample flow stream prior to collecting sample(s). Accordingly, the pump-out module M is used to initially purge from the apparatus A specimens of formation fluid taken through inlet 64 of straddle packers 28, 30, or vertical probe 10, or sink probes 12 or 14 into flow line 54.

Fluid analysis module D includes optical fluid analyzer 99 which is particularly suited for the purpose of indicating where the fluid in flow line 54 is acceptable for collecting a high quality sample. Optical fluid analyzer 99 is equipped to discriminate between various oils, gas, and water. U.S. Pat. Nos. 4,994,671; 5,166,747; 5,939,717; and 5,956,132, as well as other known patents, all assigned to Schlumberger, describe analyzer 99 in detail, and such description will not be repeated herein, but is incorporated by reference in its entirety.

While flushing out the contaminants from apparatus A, formation fluid can continue to flow through sample flow line 54 which extends through adjacent modules such as precision pressure module B, fluid analysis module D, pump out module M, flow control module N, and any number of sample chamber modules S that may be attached as shown in FIG. 2. Those skilled in the art will appreciate that by having a sample flow line 54 running the length of various modules, multiple sample chamber modules S can be stacked without necessarily increasing the overall diameter of the tool. Alternatively, as explained below, a single sample module S may be equipped with a plurality of small diameter sample chambers, for example by locating such chambers side by side and equidistant from the axis of the sample module. The tool can therefore take more samples before having to be pulled to the surface and can be used in smaller bores.

Referring again to FIGS. 1 and 2, flow control module N includes a flow sensor 66, a flow controller 68 and a selectively adjustable restriction device such as a valve 70. A predetermined sample size can be obtained at a specific flow rate by use of the equipment described above.

Sample chamber module S can then be employed to collect a sample of the fluid delivered via flow line 54 and regulated by flow control module N, which is beneficial but not necessary for fluid sampling. With reference first to upper sample chamber module S in FIG. 2, a valve 80 is opened and valves 62, 62A and 62B are held closed, thus directing the formation fluid in flow line 54 into sample collecting cavity 84C in chamber 84 of sample chamber module S, after which valve 80 is closed to isolate the sample. The tool can then be moved to a different location and the process repeated. Additional samples taken can be stored in any number of additional sample chamber modules S which may be attached by suitable alignment of valves. For example, there are two sample chambers S illustrated in FIG. 2. After having filled the upper chamber by operation of shut-off valve 80, the next sample can be stored in the lowermost sample chamber module S by opening shut-off valve 88 connected to sample collection cavity 90C of chamber 90. It should be noted that each sample chamber module has its own control assembly, shown in FIG. 2 as 100 and 94. Any number of sample chamber modules S, or no sample chamber modules, can be used in particular configurations of the tool depending upon the nature of the test to be conducted. Also, sample module S may be a multi-sample module that houses a plurality of sample chambers, as mentioned above.

It should also be noted that buffer fluid in the form of full-pressure wellbore fluid may be applied to the backsides of the pistons in chambers 84 and 90 to further control the pressure of the formation fluid being delivered to sample modules S. For this purpose, valves 81 and 83 are opened, and pump 92 of pump-out module M must pump the fluid in flow line 54 to a pressure exceeding wellbore pressure. It has been discovered that this action has the effect of dampening or reducing the pressure pulse or "shock" experienced during drawdown. This low shock sampling method has been used to particular advantage in obtaining fluid samples from unconsolidated formations.

It is known that various configurations of the apparatus A can be employed depending upon the objective to be accomplished. For basic sampling, the hydraulic power module C can be used in combination with the electric power module L, probe module E and multiple sample chamber modules S. For reservoir pressure determination, the hydraulic power module C can be used with the electric power module L, probe module E and precision pressure module B. For uncontaminated sampling at reservoir conditions, hydraulic power module C can be used with the electric power module L, probe module E in conjunction with fluid analysis module D, pump-out module M and multiple sample chamber modules S. A simulated Drill Stem Test (DST) test can be run by combining the electric power module L with packer module P, and precision pressure module B and sample chamber modules S. Other configurations are also possible and the makeup of such configurations also depends upon the objectives to be accomplished with the tool. The tool can be of unitary construction a well as modular, however, the modular construction allows greater flexibility and lower cost, to users not requiring all attributes.

As mentioned above, sample flow line 54 also extends through a precision pressure module B. Precision gauge 98 of module B should preferably be mounted as close to probes 12, 14 or 46 as possible to reduce internal flow line length which, due to fluid compressibility, may affect pressure measurement responsiveness. Precision gauge 98 is more sensitive than the strain gauge 58 for more accurate pressure measurements with respect to time. Gauge 98 is preferably a quartz pressure gauge that performs the pressure measurement through the temperature and pressure dependent frequency characteristics of a quartz crystal, which is known to be more accurate than the comparatively simple strain measurement that a strain gauge employs. Suitable valving of the control mechanisms can also be employed to stagger the operation of gauge 98 and gauge 58 to take advantage of their difference in sensitivities and abilities to tolerate pressure differentials.

The individual modules of apparatus A are constructed so that they quickly connect to each other. Preferably, flush connections between the modules are used in lieu of male/female connections to avoid points where contaminants, common in a wellsite environment, may be trapped.

Flow control during sample collection allows different flow rates to be used. Flow control is useful in getting meaningful formation fluid samples as quickly as possible which minimizes the chance of binding the wireline and/or the tool because of mud oozing into the formation in high permeability situations. In low permeability situations, flow control is very helpful to prevent drawing formation fluid sample pressure below its bubble point or asphaltene precipitation point.

More particularly, the "low shock sampling" method described above is useful for reducing to a minimum the pressure drop in the formation fluid during drawdown so as to minimize the "shock" on the formation. By sampling at the smallest achievable pressure drop, the likelihood of keeping the formation fluid pressure above asphaltene precipitation point pressure as well as above bubble point pressure is also increased. In one method of achieving the objective of a minimum pressure drop, the sample chamber is maintained at wellbore hydrostatic pressure as described above, and the rate of drawing connate fluid into the tool is controlled by monitoring the tool's inlet flow line pressure via gauge 58 and adjusting the formation fluid flowrate via pump 92 and/or flow control module N to induce only the minimum drop in the monitored pressure that produces fluid flow from the formation. In this manner, the pressure drop is minimized through regulation of the formation fluid flowrate.

Figure 3:
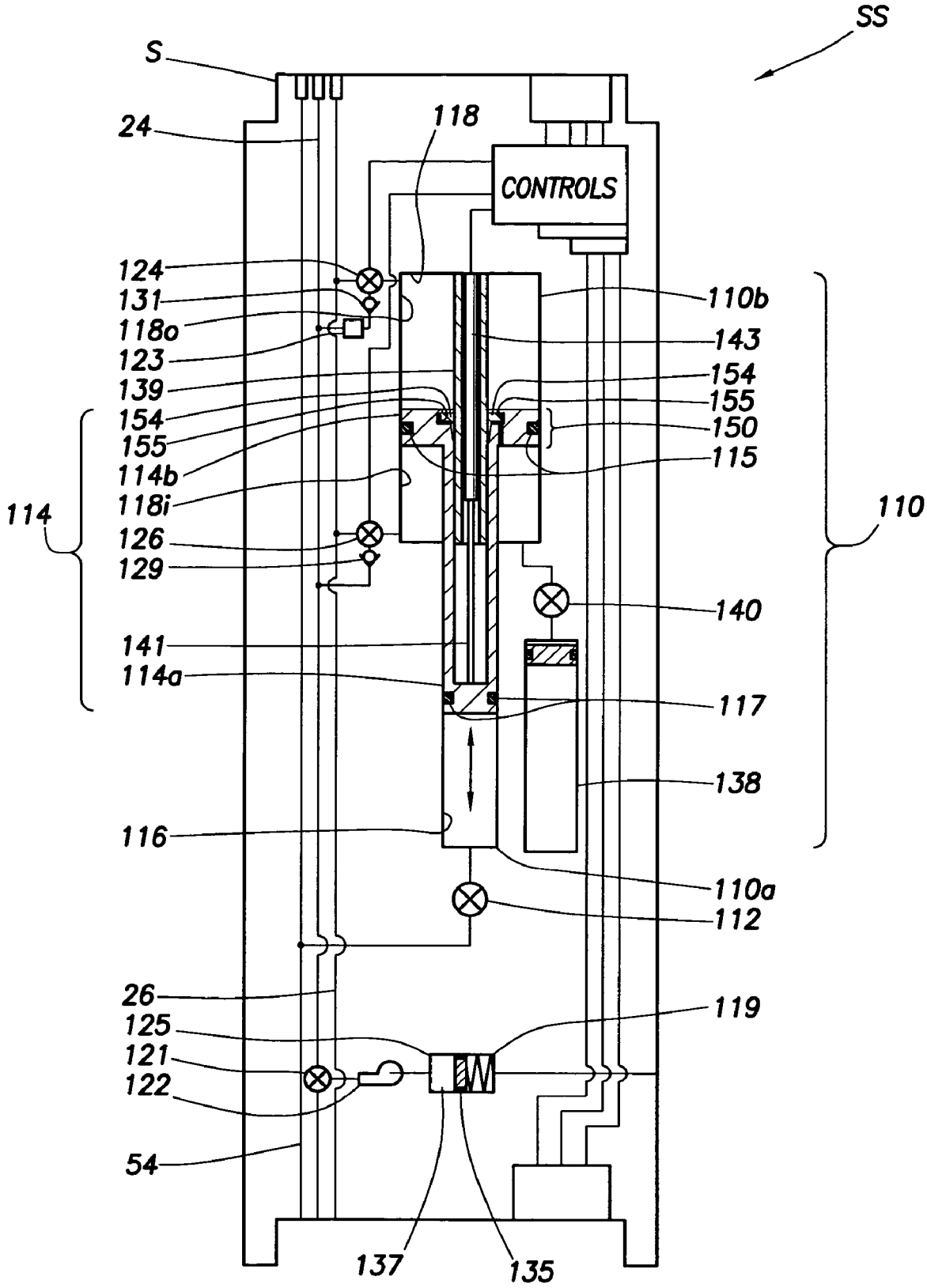
FIG. 3 is a schematic illustration of a sampling system, including a hydraulic actuator assembly.

Turning now to FIG. 3, a sampling system SS positioned in sample module S and adapted for use in a formation testing tool, such as tool A described above, is shown schematically. While depicted in a sample module, the sampling system SS may also be used in a unitary tool.

The sampling system SS includes sample tank or chamber 110 for receiving and storing formation fluid, flow line 54 for delivering formation fluid to the sample chamber, and first valve 112 for controlling the flow of formation fluid from the flow line to the sample chamber. Piston 114 is slidably disposed in sample chamber 110 to define sample cavity 116 and actuation cavity 118. The piston is preferably provided with seals 115 and 117 to fluidly separate the cavities. The cavities have variable volumes as determined by movement of the piston.

Sample chamber 110 includes first cylindrical portion 110*a* having a first internal diameter and second cylindrical portion 110*b*having a second internal diameter. The second internal diameter is larger than the first internal diameter, for purposes that are explained below. Piston 114 preferably includes first tubular portion 114 a adapted for sealed sliding movement within first cylindrical portion 110*a* of sample chamber 110, and second tubular portion 114*b* adapted for sealed sliding movement within second cylindrical portion 110*b* of the chamber. Second tubular portion 114*b* of the piston divides actuation cavity 118 into outer actuation cavity 118*o* and inner actuation cavity 118*i*.

Preferably, the volume of the cavities in the sampling system are dimensioned to facilitate the desired movement of the pistons and/or to achieve the desired actuation of the cavities. The preferred area ratios for the cavities 116, 118*i* and 118*o* are as follows:

$$\frac{Area_{118o}}{Area_{116}} \approx 2.5$$

$$\frac{Area_{118i}}{Area_{116}} \approx 1.5$$

It is preferred that the cross-sectional area of the outer actuation cavity 118*o* is greater than the cross-sectional area of the inner actuation cavity 118*i*, and that the cross-sectional area of the inner actuation cavity is greater than the cross-sectional area of the sample cavity 116. In this manner, the hydraulic fluid pressure applied to the outer actuation cavity is magnified by the ratios of the cross-sectional areas to efficiently pressurize the fluid in the sample cavity. These preferred areas are exemplary of the ratios that may be used to generate desired pressures in the sampling system. Other ratios, configurations and combinations may also be envisioned.

In the embodiment of FIG. 3, an actuator is utilized to provide the forces necessary to collect a formation fluid sample in sample cavity 116, and then overpressure the collected fluid sample to a desired pressure. This pressurization may be used to ensure that the pressure of the fluid sample does not fall below bubble point and/or asphaltene precipitation pressures during withdrawal of sampling system SS from the wellbore.

The actuator, in this case a hydraulic actuator, includes hydraulic fluid line 24 connected to source of pressurized hydraulic fluid. The source or supply of hydraulic fluid is preferably pressurized by other pressurization means, thereby allowing for the application of pressures to the formation fluid sample in sample cavity 116.

The hydraulic pressure may be provided by a hydraulic power source, such as hydraulic power module C (FIG. 1) in fluid communication with the sampling system SS via fluid line 24. Alternatively, or in combination with the hydraulic power module C, pressurization may be provided by a compensator 125 and a pump 122. The compensator 125 includes a spring loaded piston 135 slidably movable in a pressure chamber and movably divided into a first cavity 137 in fluid communication with pressurization cavity 118 via flow line 24, and a second cavity 119 in fluid communication with the borehole. The pump is charged by the compensator and provides hydraulic pressure to cavity 118 via flow line 24. Valve 121 is preferably provided to permit selective activation of the pump and compensator. Other known pressurization systems may also be used to supply hydraulic fluid sources at the desire pressures.

Optionally, since high hydraulic pressures are only needed for a small portion of the flow through the tool, it may be desirable to provide an intensifier 123. This intensifier may be used to further increase the available pressure in the sample cavity. As shown in FIG. 3, the intensifier is preferably operatively connected to the flow of fluid entering into cavity 118*o*.

Referring still to FIG. 3, second valve 126 controls the flow of hydraulic fluid from hydraulic fluid line 24 to inner actuation cavity 118*i*. Third valve 124 controls the flow of hydraulic fluid from hydraulic fluid line 24 to outer actuation cavity 118*o*. Thus, pressurized hydraulic fluid may be selectively delivered to the inner and outer actuation cavities for respectively moving the piston as indicated by the arrows.

The piston preferably moves in a first direction (away from valve 112 in FIG. 3) when valve 126 is open and/or valve 124 is closed, and a second direction (toward valve 112 in FIG. 3) when valve 124 is open and/or valve 126 is closed. The hydraulic actuator moves piston 114 in the first direction to increase the volume of sample cavity 116, and draw formation fluid from flow line 54 via first valve 112 into the sample cavity. Movement of piston 114 in the second direction decreases the volume of the sample cavity, whereby formation fluid collected in the sample cavity is pressurized. Check valves 129 and 131 are optionally provided to restrict the flow of fluid from the actuation chamber back in to fluid line 24. The valves 124 and 126 are also used to permit selective fluid communication with hydraulic fluid return line 26. Alternatively, reservoirs (not shown) may be provided.

Various options may also be used in combination with the sampling system SS to conform to various conditions or meet various needs. For example, a stationary support 139 may be disposed concentrically in the first cylindrical portion 110*a* of the sample chamber 110. The piston 114 is then adapted for sliding movement about and along the stationary support 139.

A measurement device, such as linear potentiometer may also be provided. Other measurement devices may include gauges, such as a laser, caliper, micrometer, etc. As shown in FIG. 3, the linear potentiometer includes base 143 and an extension rod 141. The base 143 is fixed to the sample chamber and extends into piston 114. If stationary support 139 is present, the base 143 is positioned therein as shown in FIG. 3. Alternatively, where no stationary support 139 is present, the piston 114 slidably moves along sample chamber 110 and base 143. The rod 141 is operatively connected to and moves with piston 114. The position of the potentiometer may be used to accurately measure the position of the piston. This position may also be used to determine various parameters, such as the sample volume in cavity 116, compressibility, and/or other parameters. Such measurements may be used alone or in combination with other measurements, such as a pressure gauge for determining other parameters, such as bubble-point.

As shown in FIG. 3, a locking mechanism 150 may also be provided to selectively permit movement of the piston in the desired direction. The locking mechanism 150 includes a wedge 154 and springs (not shown). Preferably, the locking mechanism locks the piston in place along the support 139. In the configuration depicted in FIG. 3, the locking mechanism preferably locks the piston in place in an increased pressure condition. In other words, when a sample is taken and pressure is increased, the locking mechanism may be activated to lock the piston in position and retain the sample at the increased pressure level.

Wedges 154 are preferably self-locking wedges that are positioned in cavities 155 in second tubular portion 114*b* of piston 114. The wedges 154 are operatively connected to and travel with the piston. The wedges are movable between a locked position preventing movement of the piston and an unlocked position permitting movement of the piston. Springs (not shown) are operatively connected to each wedge and apply a compressive force urging the wedges to the unlocked position. In the unlocked position, the wedges are positioned in cavities 155 and are in non-engagement with the support 139. In the locked position, the force of the springs is overcome by pressures in the cavities and the wedges extend from the cavities 155 to provide frictional engagement between the piston 115 and support 139 thereby restricting movement of the piston.

Piston 114 is provided with vent holes (not shown) extending through piston 114 such that ventilation is created between cavities 118*i* and the back of the wedge. Preferably, the locking mechanism is configured such that where there insufficient pressure differential, then the wedge will not move. When pressure in cavity 118*o* is sufficiently different from and lower than the pressure in cavity 118*i* such that the pressure differential therebetween is great, the compressive force of the fluid and/or spring drives the wedges to the unlocked position thereby allowing the piston to slide freely along support 139. When pressure in cavity 118*o* is sufficiently different from and greater than the pressure in cavity 118*i* such that the pressure differential therebetween is great, the pressure overcomes the force of the spring and drives the wedges to the locked position thereby forcing the wedge between the piston and the support and preventing movement of the piston. This provides a one direction mechanical lock that prevents the piston 114 from moving. By preventing movement of the piston, the pressure in sample cavity 116 is maintained as the tool is withdrawn from the well. The pressure may be maintained even though the pressure in the outer actuation cavity may change.

A source of fluid, such as an atmospheric chamber 138 at reduced pressure, may be placed in selective communication via valve 140 with the inner actuation cavity 118*i*. The pressure within cavity 118*i* may be reduced by fluid communication between chamber 138 and sample cavity 118*i* thereby increasing the pressure applied to the sample cavity 116 by the pressure in the outer actuation cavity 118*o*. The chamber 138 may be used to provide for high over-pressurization while significantly lowering the requirements of the hydraulic supply. After the sample is taken, and compressed to the limit of the hydraulic supply, the pressurization valve 140 may be opened to further pressurize the sample.

Figure 4:
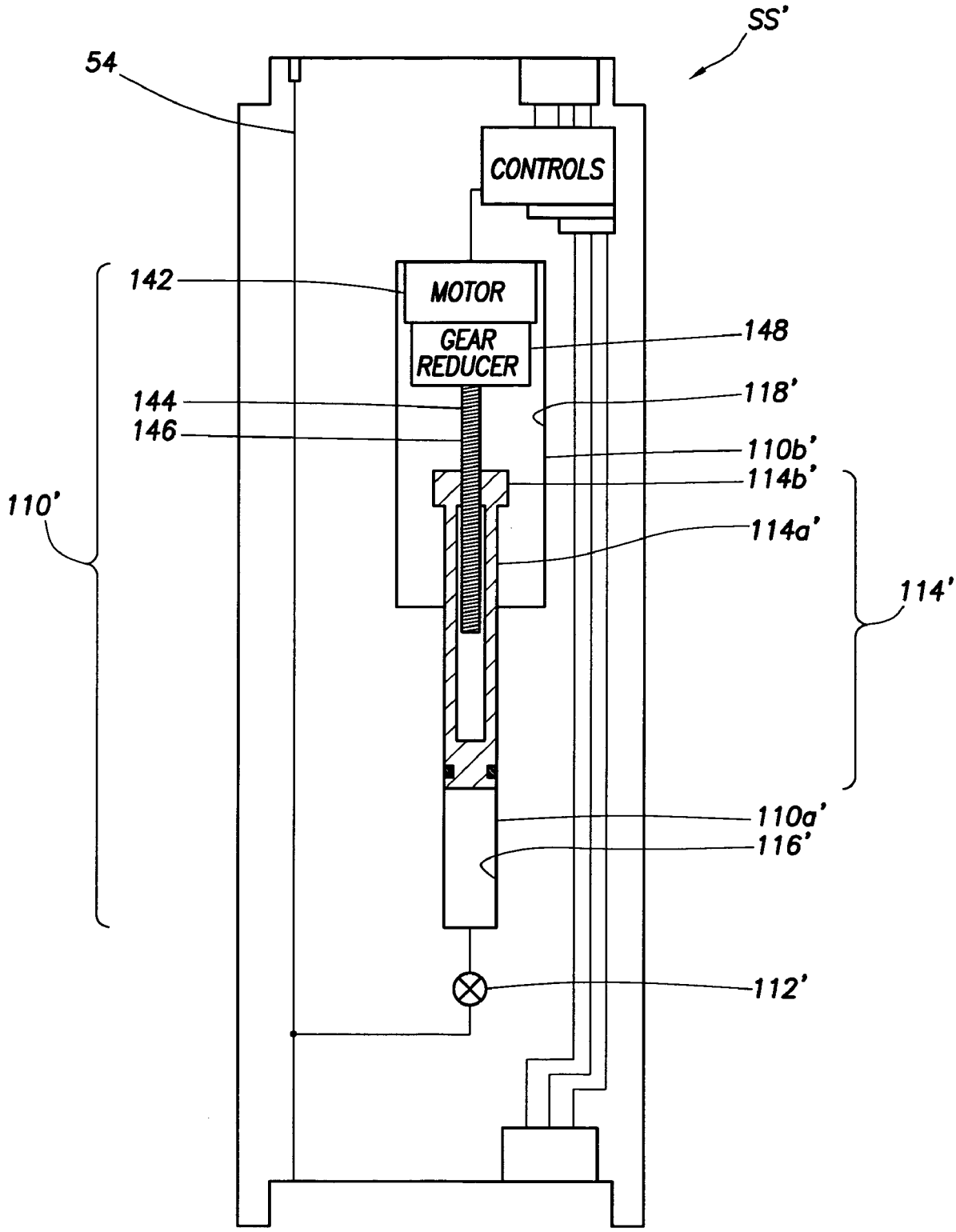
FIG. 4 is a schematic illustration of a sampling system, including an electromechanical actuator.

Referring now to FIG. 4, another embodiment of a sampling system SS' is depicted. Sampling system SS' includes sample tank or chamber 110' for receiving and storing formation fluid, flow line 54 for delivering formation fluid to the sample chamber, and first valve 112' for controlling the flow of formation fluid from the flow line to the sample chamber. Piston 114' is slidably disposed in sample chamber 110' to define sample cavity 116' and actuation cavity 118'. The cavities have variable volumes as determined by movement of the piston.

Sample chamber 110' includes first cylindrical portion 110*a'* having a first internal diameter and second cylindrical portion 110*b'* having a second internal diameter. The second internal diameter is larger than the first internal diameter. Piston 114' preferably includes first tubular portion 114*a'* adapted for sealed sliding movement within first cylindrical portion 110*a'* of sample chamber 110', and second portion 114*b'* having a diameter larger than the diameter of cavity 116' to provide a positive stop preventing further advancement of the piston 114' into cavity 116'. While sample chamber 110' is depicted as having a first internal diameter and a second internal diameter it will be appreciated by one of skill in the art that different diameters are not required. Additionally, the physical stop provided by second portion 114*b'* is also optional. The actuator may be used to stop the piston at the desired position within the chamber.

In the embodiment of FIG. 4, an actuator is utilized to provide the forces necessary to collect a formation fluid sample in sample cavity 116', and then overpressure the collected fluid sample to ensure that the pressure of the fluid sample does not fall below bubble point or asphaltene precipitation pressures during withdrawal of sampling system SS' and formation tester A from the wellbore.

The actuator, in this case an electromechanical actuator, includes an electric motor 142, and a power screw assembly 144 driven by the electric motor. The power screw assembly 144 has a lead screw 146 operatively connected to the piston for selectively moving the piston The piston preferably moves in a first direction (away from 112' in FIG. 4) and a second direction (toward valve 112' in FIG. 4). The actuator moves piston 114' in the first direction to increase the volume of sample cavity 116', and draw formation fluid from flow line 54 via first valve 112' into the sample cavity. Movement of piston 114' in the second direction decreases the volume of the sample cavity, whereby formation fluid collected in the sample cavity is pressurized therein using the actuator and the first valve.

Preferably, the actuator further includes a variable ratio gear reducer 148 disposed between the electric motor 148 and the power screw assembly 146 for efficient application of the electric motor's torque to the power screw assembly.

The actuator may be used alone or in combination with the gear reducer 148 to apply pressure to a sample captured in chamber 116. The position of the piston may then be selectively adjusted to maintain the pressure of the sample at the desired level. Various options, such as those discussed with respect to FIG. 3 may also be used in combination with the sampling system of FIG. 4. Various combinations of the sampling systems of FIGS. 3 and 4 are also envisioned. For example, the atmospheric chamber 138 of FIG. 3 may also be used with sampling system SS' of FIG. 4 and/or second portion 114*b'* of piston 114 may be slidably positioned within actuation cavity 118' to divide the cavity into inner and outer cavities.

The sampling systems of FIGS. 3 and 4 are preferably provided with controllers capable of selectively activating portions of the sampling system, collecting information, communicating, or otherwise operating the downhole tool and/or sampling system. By manipulating the sampling system, the downhole tool may be provided with capabilities for inducing large controlled pulses in the formation for multi-probe tests, performing in reverse for injection tests for pressure measurements with viscous oils, measuring flow rates for downhole applications, performing flow controls, providing samples for a PVT cell if instrumented, providing an alternative to low shock sampling (The hydrostatic pressure of the well is replaced by hydraulic pressure in the chamber behind the piston), injecting treatment fluids into the formation as well as other applications.

In operation, the apparatus as depicted in FIGS. 3 and 4 may be operated in either a sampling or injecting mode. In the sampling mode, fluid samples are drawn into the sample chamber. In the ejection, or reverse, mode, fluid is ejected from the sample chamber into the surrounding formation. Fluid may be inserted into the sample chamber and/or pressurized prior to lowering the apparatus into the wellbore. Fluids, such as dyes, radioactive tracers, treatment fluids (ie. acids), may optionally be used. Fluids of known specific viscosities may be used so that the flow rate of the fluid may be used to determine formation parameters, such as porosity and/or permeability. Alternatively, the fluid may be drawn into the chamber via the normal sampling operation and subsequently ejected into the surrounding formation.

To assist in the recovery of high quality fluid samples, it may be desirable to control the movement of the piston during drawdown to generate a minimum drawdown pressure. In other words, by limiting the rate of piston movement, the drawdown pressure may effectively be controlled to a desired range. This can be done by taking samples against high pressure generated within the tool hydraulics.

When sampling using the devices described herein, it may be desirable to stroke the piston back and forth to purge the lines prior to taking in the sample. Additionally, a pressure gauge may be added to the sample chamber for additional analysis. The pressure gauge readings may be used in combination with controlled piston movement to analyze the sample, such as with known PVT techniques.

In view of the foregoing it is evident that the present invention is well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive. The scope of the invention is indicated by the claims that follow rather than the foregoing description, and all changes which come within the meaning and range of equivalence of the claims are therefore intended to be embraced therein.

The invention claimed is:

1. A method of injecting fluid into a formation, comprising:

providing a formation testing apparatus having a piston therein that divides a sample chamber into a fluid cavity and an actuation cavity;

inserting fluid into the fluid cavity through a flowline;

positioning the apparatus in the wellbore;

pressurizing the fluid in the fluid cavity;

establishing selective fluid communication between the fluid cavity and the formation; and inducing movement of the piston to inject fluid from the fluid cavity into the formation through the flowline.

2. A downhole injection tool positionable in a wellbore penetrating a subsurface formation, said injection tool comprising:

a chamber for storing an injection fluid;

a flow line for delivering said injection fluid to the chamber and for delivering said injection fluid to the formation;

a first valve disposed in the flow line for controlling the flow of injection fluid from said chamber to the formation;

a piston slidably disposed in said chamber to define an injection fluid cavity and an actuation cavity, the cavities having variable volumes determined by movement of said piston; and an actuator in the chamber for moving said piston in a first direction to increase the volume of the injection fluid cavity and a second direction to decrease the volume of the injection fluid cavity, whereby injection fluid may ejected from the injection fluid cavity through the flow line.

3. The downhole injection tool of claim 2, further comprising a pump and a compensator.

4. The downhole injection tool of claim 2, wherein said chamber includes a first cylindrical portion having a first internal diameter and a second cylindrical portion having a second internal diameter, the second internal diameter being larger than the first internal diameter, and said piston has a first tubular portion adapted for scaled sliding movement within the first cylindrical portion of said chamber and a second tubular portion adapted for sealed sliding movement within the second cylindrical portion of said chamber, the second tubular portion of said piston defining the inner and outer actuation cavities within the second cylindrical portion of said chamber.

5. The downhole injection tool of claim 4, further comprising a stationary tubular element disposed concentrically in the first cylindrical portion of said chamber, and wherein the first and second tubular portions of said piston are adapted for sliding movement about and along said stationary tubular element.

6. The downhole injection tool of claim 4, wherein the cross-sectional area of the outer actuation cavity is greater than the cross-sectional area of the inner actuation cavity, and the cross-sectional area of the inner actuation cavity is greater than the cross-sectional area of the injection fluid cavity, whereby the hydraulic fluid pressure applied to the outer actuation cavity is magnified by the ratios of the cross-sectional areas to efficiently pressurize the fluid in the injection fluid cavity.

7. The downhole injection tool of claim 4, further comprising a source of fluid at reduced pressure placed in selective communication with the inner actuation cavity, whereby a pressure within the inner actuation cavity may be reduced by fluid communication with the reduced-pressure source to increase the pressure applied to the injection fluid cavity by the pressure in the outer actuation cavity.

8. A method for injecting fluid into a subsurface formation penetrated by a wellbore, comprising:

providing a formation testing apparatus having a sample chamber with a piston therein that divides the sample chamber into a fluid cavity and an actuation cavity;

inducing movement of the piston in a first direction using an actuator in the sample chamber so as to expand the sample cavity and thereby deliver injection fluid into the sample cavity;

closing a control valve disposed in a flowline to the sample chamber;

positioning the formation testing apparatus into a wellbore;

pressurizing the injection fluid in the sample chamber;

establishing selective fluid communication via the control valve between the sample cavity and the formation;

opening the control valve disposed in the flowline; and injecting the injection fluid into the formation via the flowline.

* * * * *